US009534452B2

(12) United States Patent
Hatton

(10) Patent No.: US 9,534,452 B2
(45) Date of Patent: Jan. 3, 2017

(54) SUBSEA CONDUIT SYSTEM

(71) Applicant: Magma Global Limited, Portsmouth (GB)

(72) Inventor: Stephen Hatton, Surrey (GB)

(73) Assignee: Magma Global Limited, Portsmouth (GB)

( * ) Notice: Subject to any disclaimer, the term of this patent is extended or adjusted under 35 U.S.C. 154(b) by 0 days.

(21) Appl. No.: 14/057,336

(22) Filed: Oct. 18, 2013

(65) Prior Publication Data

US 2014/0044493 A1 Feb. 13, 2014

Related U.S. Application Data

(63) Continuation of application No. PCT/GB2012/000353, filed on Apr. 18, 2012, which is a continuation-in-part of application No. 13/158,100, filed on Jun. 10, 2011, now abandoned.

(30) Foreign Application Priority Data

| | | |
|---|---|---|
| Apr. 18, 2011 | (GB) | 1106473.0 |
| Jul. 20, 2011 | (GB) | 1112469.0 |
| Sep. 20, 2011 | (GB) | 1116227.8 |

(51) Int. Cl.
*E21B 17/01* (2006.01)
*E21B 17/08* (2006.01)

(52) U.S. Cl.
CPC ..... *E21B 17/01* (2013.01); *E21B 17/015* (2013.01); *E21B 17/085* (2013.01)

(58) Field of Classification Search
CPC ..... E21B 17/015
USPC ..... 166/367, 338, 344, 351, 352, 380
See application file for complete search history.

(56) References Cited

U.S. PATENT DOCUMENTS

| | | | | |
|---|---|---|---|---|
| 3,834,432 | A * | 9/1974 | Lilly et al. | 141/388 |
| 4,200,054 | A * | 4/1980 | Elliston | 114/264 |
| 4,263,004 | A * | 4/1981 | Joubert et al. | 405/172 |
| 4,448,266 | A | 5/1984 | Potts | |
| 4,740,110 | A | 4/1988 | Saffrhan | |
| 4,906,137 | A * | 3/1990 | Maloberti et al. | 405/224.3 |
| 5,944,448 | A * | 8/1999 | Williams | 405/169 |
| 5,957,074 | A * | 9/1999 | de Baan et al. | 114/230.12 |

(Continued)

FOREIGN PATENT DOCUMENTS

| | | |
|---|---|---|
| GB | 2204291 A | 11/1988 |
| WO | WO 2005/103436 | 11/2005 |

(Continued)

OTHER PUBLICATIONS

International Search Report and Written Opinion in corresponding PCT Application No. PCT/GB2012/000353 dated Aug. 2, 2013.

*Primary Examiner* — Matthew R Buck
*Assistant Examiner* — Aaron Lembo
(74) *Attorney, Agent, or Firm* — Levy & Grandinetti

(57) ABSTRACT

A subsea conduit system comprises a conduit extending between a surface vessel and a subsea support, and a load arrangement connected between a subsea anchor and the conduit at a region of connection which is intermediate the vessel and the subsea support to apply a force on the conduit. The conduit is configured such that the applied force generates axial tension in the conduit between the region of connection and the vessel, and between the region of connection and the subsea support.

40 Claims, 4 Drawing Sheets

(56) References Cited

U.S. PATENT DOCUMENTS

| | | | | |
|---|---|---|---|---|
| 6,062,769 | A * | 5/2000 | Cunningham | 405/195.1 |
| 6,082,391 | A * | 7/2000 | Thiebaud et al. | 137/236.1 |
| 6,109,197 | A * | 8/2000 | Breivik et al. | 114/230.2 |
| 6,109,830 | A * | 8/2000 | de Baan | 405/170 |
| 6,146,052 | A * | 11/2000 | Jacobsen et al. | 405/169 |
| 6,227,138 | B1 * | 5/2001 | Breivik et al. | 114/293 |
| 6,461,083 | B1 * | 10/2002 | Pionetti et al. | 405/224.2 |
| 6,857,822 | B2 * | 2/2005 | Hooper et al. | 405/224.4 |
| 7,712,539 | B2 * | 5/2010 | Einar | 166/355 |
| 7,946,790 | B2 * | 5/2011 | Casola et al. | 405/169 |
| 8,001,996 | B2 * | 8/2011 | Paulshus et al. | 138/109 |
| 8,152,411 | B2 * | 4/2012 | Ottesen et al. | 405/172 |
| 8,905,143 | B2 * | 12/2014 | Joensen et al. | 166/367 |
| 2005/0063788 | A1 * | 3/2005 | Clausen | 405/224.2 |
| 2005/0196243 | A1 * | 9/2005 | Pollock et al. | 405/224.3 |
| 2006/0188342 | A1 * | 8/2006 | Salama et al. | 405/224.2 |
| 2008/0253842 | A1 | 10/2008 | Wolbers et al. | |
| 2009/0269141 | A1 | 10/2009 | Li et al. | |
| 2010/0034594 | A1 * | 2/2010 | Major | 405/219 |
| 2011/0017465 | A1 * | 1/2011 | Wales et al. | 166/339 |
| 2011/0073315 | A1 * | 3/2011 | Guesnon et al. | 166/367 |
| 2011/0129305 | A1 * | 6/2011 | Withall et al. | 405/224.2 |
| 2011/0146797 | A1 * | 6/2011 | Tan et al. | 137/1 |
| 2011/0162748 | A1 | 7/2011 | Morand et al. | |
| 2012/0107050 | A1 * | 5/2012 | Wolbers et al. | 405/171 |
| 2013/0216317 | A1 * | 8/2013 | Tan et al. | 405/224.3 |
| 2013/0292129 | A1 * | 11/2013 | Tan et al. | 166/350 |

FOREIGN PATENT DOCUMENTS

| | | | |
|---|---|---|---|
| WO | 2009/063163 | A1 | 5/2009 |
| WO | 2009/139636 | A1 | 11/2009 |
| WO | 2010/012898 | A1 | 2/2010 |

* cited by examiner

SUBSEA CONDUIT SYSTEM

FIELD OF THE INVENTION

The present invention relates to a subsea conduit system, and in particular, but not exclusively, to a subsea composite riser system.

BACKGROUND OF THE INVENTION

Several configurations for connecting floating structures with a seabed pipeline or wellhead system for the purposes of fluid transfer therebetween are known in the art, and are commonly used in the offshore oil and gas industry.

One frequently used configuration is known as the free-hanging catenary configuration, often called a Simple Catenary Riser or SCR. Such a riser configuration is illustrated in FIG. 1 and includes a riser pipe 10 freely hung from a host vessel 12, such as a FPSO vessel, and forming a curved shape downwards until it lands on the seabed 14 at a touchdown point 16. After the touchdown point 16, the pipe horizontally lies on the seabed 14 and connects to subsea facilities, such as subsea hydrocarbon production facilities and infrastructure (not illustrated in FIG. 1). In this configuration, and regardless of the type of riser pipe 10 used, the oscillations of the vessel 12 may induce high curvature fluctuations of the pipe in the lower part of the riser, especially in the region of the touchdown point 16. This curvature can overstress the pipe and additionally may lead to significant fatigue-damage in the vicinity of the touchdown point of the riser.

When a riser, in this free-hanging configuration, consists of a rigid tube formed of metal such as steel, the radius of curvature at the touchdown point is made relatively large to minimise the possibility of stress exceeding the yield strength of the metallic pipe material. However, this may result in the requirement to use longer lengths of riser pipe, which can significantly increase the weight of the riser, giving rise to additional problems, such as exceeding vessel deck load limits and the like. Furthermore, this free hanging catenary configuration is highly sensitive to fatigue damage accumulation particularly at the welds used to connect the individual metallic pipe sections together.

A method for optimising the response in metal risers of this known catenary form is to apply buoyancy modules along the near horizontal section of the riser to favourably modify its response in the vicinity of the touchdown point. Varying quantities and distributions of buoyancy may be considered from small amounts that only provide a small upthrust and almost imperceptible change in curvature, to larger quantities that can result in large sections of pipe being vertically lifted off the seabed to form a riser shape that is often referred to as a wave catenary. Such a wave catenary form is illustrated in FIG. 2, wherein a riser pipe 20 is again hung from a vessel 22 and extends to the seabed 24. A section of the riser pipe 20 includes buoyancy modules 26, such as syntactic foam and/or aircans, which establish a wave configuration 28 along the length of the riser pipe 20. This wave configuration 28 assists to largely decouple the effect of motion of the vessel 22 from the riser pipe 20 at the region of a touchdown point 30 with the seabed 24, thus assisting to minimise stress and fatigue in this region.

A flexible pipe made from alternating layers of helically wound steel and thermoplastic materials may be used in deep seas in the free-hanging configuration. Such layered flexible pipe is typically known as non-bonded pipe in the art. Such flexible non-bonded pipe, when used in the SCR form, may have advantages over metallic equivalents, for example in that a smaller radius of curvature at the touchdown point may be permissible. Furthermore, flexible pipe may allow greater vertical and horizontal movements of the host vessel at the water surface due to smaller allowable bend radii and improved fatigue behaviour. However, known flexible pipe may have the drawbacks of being very heavy, exhibiting inferior thermal insulation, and having a higher cost per unit length than steel equivalents.

A further riser configuration uses the combination of buoyancy modules attached to the riser pipe to form an arch or wave in combination with a tensioned seabed tether which anchors a point on the riser below the wave to a fixed point on the seabed. This tether is assembled from steel wires or chain and is used to control riser shape and deflections. This configuration is commonly referred to as a Pliant wave. A development of the Pliant wave arrangement is proposed in WO 2009/139636.

A further wave catenary configuration is disclosed in US 2009/0269141 which proposes a combination of tethers and buoyancy modules wherein the tether is connected under tension between a point of fixity on the seabed and a point on the riser that is coincident with the point of application of the buoyancy modules.

The foregoing SCR and Wave catenary risers are primarily applicable to metallic steel pipe risers and non-bonded flexible pipe risers. These pipe constructions are often heavy and result in high tensions and payloads on the host vessel. However, the benefit of such high tensions is that they assist the stability of the riser structure to resist the application of hydrodynamic current forces.

Free standing or hybrid risers are also often used in the oil and gas industry to transfer fluids from surface vessels to and from subsea wellheads and pipelines. Free standing risers are typically used in deep water and comprise a long, stiff and largely vertical lower section which is quasi static, and a shorter flexible near surface upper section configured in a free hanging catenary configuration. The catenary upper section, typically called a flexible jumper, is designed to accommodate vessel motions and is typically constructed from non-bonded flexible pipe. As noted above, non-bonded flexible pipe has the benefit that it can accommodate small bend radii and this along with its relatively heavy in-water weight allows acceptable configurations to be achieved even when vessel motions and mooring excursions are large. However the disadvantage is that its weight can be excessive and this can detrimentally add to vessel and riser payload. Additionally, non-bonded flexibles have further limitations on their maximum diameter, maximum service temperature, sour service acceptability and long term robustness.

Generally, subsea pipelines, whether extending from surface to seabed, or simply extending entirely subsea, may suffer from similar issues to those identified above, such as requirement to minimise regions of high stress and fatigue, control of dynamic response to environmental conditions, excessive weight and the like.

SUMMARY OF THE INVENTION

An aspect of the present invention may relate to a subsea conduit or riser system comprising:

a conduit extending between a surface vessel and a subsea support, wherein the surface vessel and subsea support are subject to relative motion therebetween; and a load arrangement connected between a subsea anchor and the conduit at a region of connection which is intermediate the vessel and the subsea support to tether the conduit to the subsea anchor and to generate axial tension in the conduit between the region of connection and the vessel, and between the region of connection and the subsea support.

A further aspect of the present invention may relate to a method for establishing communication between a surface vessel and a subsea support, wherein the surface vessel and subsea support are subject to relative motion therebetween, comprising:

extending a riser conduit between the vessel and the subsea support;

connecting a load arrangement between a subsea anchor and the conduit at a region of connection which is intermediate the vessel and the subsea support to tether the conduit to the subsea anchor and to generate axial tension in the conduit between the region of connection and the vessel, and between the region of connection and the subsea support.

Another aspect of the present invention may relate to a subsea conduit system comprising:

a conduit extending between a surface or near surface vessel and a subsea support; and a load arrangement connected to the conduit at a region of connection which is intermediate the vessel and the subsea support to apply a force on the conduit;

wherein the conduit is configured such that the applied force generates axial tension in the conduit between the region of connection and the vessel.

In use, fluid communication may be achieved between a subsea location and the surface or near surface vessel via the conduit system. In such an application the subsea conduit system may define a riser system or portion thereof. Further, in such an application the conduit may be defined as a fluid conduit.

The subsea conduit system may be configured to accommodate fluid communication from a subsea location to a surface or near surface vessel. In one particular embodiment the subsea conduit system may be configured to accommodate fluid communication of hydrocarbon product from a subsea production field to a surface or near surface vessel, such as a FPSO vessel.

The conduit system may be configured to accommodate fluid communication from a surface or near surface vessel to a subsea location. For example, the conduit system may accommodate fluid communication of, for example, hydraulic fluid for actuation of a tool, injection fluids for injection into a subterranean wellbore, purging fluid and the like.

The conduit may define a single component extending between the vessel and subsea support. That is, the conduit may extend as a continuous length between the vessel and the subsea support, thus eliminating the requirement for any connectors and the like.

In some embodiments the force applied by the load arrangement may be aligned axially relative to the conduit.

The force applied by the load arrangement may be aligned laterally relative to the conduit. For example, the force applied on the conduit by the load arrangement may be considered to be non-parallel with the longitudinal axis of the conduit at the region of connection of the load arrangement. For example the force may be oblique and/or perpendicular relative to the conduit longitudinal axis.

The presence of the force of the load arrangement and the tension generated in the conduit may function to permit the dynamic response of at least this section of the conduit to be improved relative to an unloaded conduit. For example, the force and the tension generated may permit the conduit to exhibit improved static stability to resist deformation or deviation caused by external forces, such as water current loading and relative motion between the vessel and subsea support. The load arrangement and generated tension may permit the conduit to resist higher external forces, while being capable of a degree of compliancy to the effects of increasing external forces.

In the present invention the conduit is configured such that tension is generated between the region of connection of the load arrangement and the vessel. Accordingly, the effect of the load arrangement is capable of being applied along the entire length of the conduit back to the vessel. This may permit improved stability over this length of the conduit back to the vessel.

The conduit may extend continuously upwards between the region of connection with the load arrangement and the vessel. The conduit may extend continuously between the region of connection with the load arrangement and the vessel without defining any inflection points. This arrangement may permit the conduit to transmit the tension generated by the effect of the load arrangement back to the vessel, such that the tension within the conduit may be reacted off the vessel.

The load arrangement may be configured to apply a force on the conduit to generate tension along the entire length of the conduit between the vessel and the subsea support. That is, the load arrangement may be configured to apply a force on the conduit to generate axial tension between the region of connection and the vessel, and also between the region of connection and the subsea support. This arrangement may permit the load arrangement to improve the stability and dynamic response of the entire length of the conduit extending between the vessel and subsea support.

The conduit may extend continuously between the region of connection with the load arrangement and the subsea support without defining any inflection points. This arrangement may permit the conduit to transmit the tension generated by the effect of the load arrangement back to the subsea support such that the tension within the conduit may be reacted off the subsea support.

The applied force and generated tension may permit the conduit to exhibit a dynamic response and level of stability which is more typical of heavier conduits (i.e., conduits having a greater weight per unit length), in particular metallic conduits. Thus, the presence of the load arrangement may permit lighter conduits to be utilised, such as conduits formed of a composite material which exhibit greater flexibility, improved strain behaviour and the like, offering advantages in subsea applications. Nevertheless, while certain properties of light weight conduits, such as composite conduits, may be advantageous in a subsea environment, their use may be considered to create additional problems and complexities, for example due to their poorer dynamic stability. In view of this those skilled in the art may opt to use heavier conduits. However, heavier conduits, such as metallic conduits, have associated problems such as their poorer ability to accommodate bending and axial strains and the like. Such problems may be addressed by the conduit system according to the first aspect, in that the load arrangement and generated tension may permit lighter weight conduits to be utilised where they would otherwise be disregarded as inappropriate, thus in turn also avoiding the problems associated with heavier conduits, such as metallic conduits.

The conduit may comprise a composite material formed of at least a matrix and one or more reinforcing elements embedded within the matrix.

The composite construction of the conduit may permit said conduit to exhibit sufficiently high strength to accommodate pressure and other applied loadings. Furthermore, the composite construction may facilitate improved strain behaviour, such as permitting increased axial extension and contraction due to axially applied loading, increased bending strains and the like. The ability to accommodate increased strains may permit improved compliancy of the conduit within a subsea environment. Further, the ability to accommodate increased bending strains may permit the conduit to define smaller bend radii, which may be particularly advantageous, for example in the regions of connection with the vessel, subsea support and/or of the load arrangement.

As suggested above, the composite construction may permit the conduit to be significantly lighter than non-composite pipe, such as metallic pipe or non-bonded pipe. This may reduce the load transferred to, for example, the vessel and/or the subsea support. Further, the lighter weight construction of a composite conduit may facilitate easier handling, deployment and retrieval.

The composite construction of the conduit may permit significantly improved thermal characteristics in comparison to non-composite pipe structures. For example, the composite construction may provide greatly reduced thermal conductivity which reduces heat loses and may allow the need for separate insulation to be eliminated or greatly reduced. Furthermore, the composite construction may assist to minimise thermal expansion characteristics. For example, the composite construction of the conduit may permit lower axial length variation compared to non-composite structures and thus assist to eliminate or at least alleviate associated problems. However, even in circumstances where axial length variation does occur, such variations may be accommodated by the composite construction by virtue of an increased ability to accommodate higher strain rates. Thus, for example, axial compression and tensile forces may be more readily accommodated. Furthermore, any lateral deformations caused by axial extension may also be readily accommodated without risk of exceeding operational yield limits.

The entire axial length of the conduit extending between the vessel and the subsea support may comprise a composite material.

Discrete portions of the axial length of the conduit may comprise a composite material. For example, in one embodiment a discrete axial length of the conduit in the region of connection with the load arrangement may comprise a composite material. This arrangement may facilitate improved structural behaviour at this region where the lateral force is applied to the conduit.

The conduit may be formed exclusively from the composite material. For example, the entire wall thickness of the conduit may be formed of the composite material. In some embodiments the quantity of reinforcing elements may vary through the wall thickness of the conduit. In one embodiment the quantity of reinforcing elements may vary from zero at the inner region of the wall of the conduit, and increase in quantity in an outwardly radial direction. In such an arrangement the inner region of the conduit wall may be composed substantially entirely of matrix material.

The matrix of the composite material of the conduit may comprise a polymer material. The matrix may comprise a thermoplastic material. The matrix may comprise a thermoset material. The matrix may comprise a polyaryl ether ketone, a polyaryl ketone, a polyether ketone (PEK), a polyether ether ketone (PEEK), a polycarbonate or the like, or any suitable combination thereof. The matrix may comprise a polymeric resin, such as an epoxy resin or the like.

The reinforcing elements of the composite material of the conduit may comprise continuous or elongate elements. The reinforcing elements may comprise any one or combination of polymeric fibres, for example aramid fibres, or non-polymeric fibres, for example carbon, glass or basalt elements or the like. The reinforcing elements may comprise fibres, strands, filaments, nanotubes or the like. The reinforcing elements may comprise discontinuous elements.

The matrix and the reinforcing elements of the composite material of the conduit may comprise similar or identical materials. For example, the reinforcing elements may comprise the same material as the matrix, albeit in a fibrous, drawn, elongate form or the like.

The composite material of a wall of the conduit may comprise or define a local variation in construction to provide a local variation in a property of the conduit.

Such a local variation in a property of the conduit may permit tailoring of a response of the conduit to given load conditions.

The local variation in construction may comprise at least one of a circumferential variation, a radial variation and an axial variation in the composite material and/or the conduit geometry.

In some embodiments at least one location of the conduit which is configured to interact with another structure, for example at the connection with the load arrangement, vessel and/or subsea support, may define a local region of increased strength, for example by modified strength properties of the composite material components, by modified geometry, such as thicker material regions, or the like.

The local variation in construction may comprise a local variation in the composite material.

The local variation in construction may comprise a variation in the matrix material. The local variation in construction may comprise a variation in a material property of the matrix material such as the strength, stiffness, Young's modulus, density, thermal expansion coefficient, thermal conductivity, or the like.

The local variation in construction may comprise a variation in the reinforcing elements. The local variation in construction may comprise a variation in a material property of the reinforcing elements such as the strength, stiffness, Young's modulus, density, distribution, configuration, orientation, pre-stress, thermal expansion coefficient, thermal conductivity or the like. The local variation in construction may comprise a variation in an alignment angle of the reinforcing elements within the composite material. In such an arrangement the alignment angle of the reinforcing elements may be defined relative to the longitudinal axis of a fluid conduit. For example, an element provided at a 0 degree alignment angle will run entirely longitudinally of the conduit, and an element provided at a 90 degree alignment angle will run entirely circumferentially of the conduit, with elements at intermediate alignment angles running both circumferentially and longitudinally of the conduit, for example in a spiral or helical pattern.

The local variation in the alignment angle may include elements having an alignment angle of between, for example, 0 and 90 degrees, between 0 and 45 degrees or between 0 and 20 degrees.

At least one portion of the conduit wall may comprise a local variation in reinforcing element pre-stress. In this arrangement the reinforcing element pre-stress may be considered to be a pre-stress, such as a tensile pre-stress and/or compressive pre-stress applied to a reinforcing element during manufacture of the conduit, and which pre-stress is at least partially or residually retained within the manufactured conduit. A local variation in reinforcing element pre-stress may permit a desired characteristic of the conduit to be achieved, such as a desired bending characteristic. This may assist to position or manipulate the conduit, for example during installation, retrieval, coiling or the like. Further, this local variation in reinforcing element pre-stress may assist to shift a neutral position of strain within the conduit wall, which may assist to provide more level strain distribution when the fluid conduit is in use, and/or for example is stored, such as in a coiled configuration.

The conduit may comprise a variation in construction of composite material along its length to provide a variation in axial strength. For example, an upper region of a fluid conduit at the region of the vessel which is typically exposed to greater tensile forces, for example due to self-weight, may be provided with a composite material construction with a greater resistance to tensile forces than a lower region of the conduit. This may facilitate tailoring of the conduit to the precise operational conditions, which may result in a reduction in material usage and thus costs.

The conduit may define a curved profile.

The conduit may extend between the vessel and subsea support in a general catenary form, and in particular in a simple catenary form. In such an arrangement the presence of the load arrangement and the applied force may modify the general curvature of a simple catenary. For example, the presence of the load arrangement may cause the conduit to define a general dog-leg catenary form, having a first leg extending between the vessel and the region of connection of the load arrangement, and a second leg between the region of connection and the subsea support. Both the first and second legs may extend in a common direction, such that the region of connection is located intermediate the lateral separation between the vessel and the subsea support (or that part of the conduit located at the vessel and subsea support). This arrangement may provide improved structural integrity of the conduit, for example by minimising any regions of significant deviation or direction change along the length of the conduit.

The conduit may terminate at the vessel. Alternatively, the conduit may extend beyond the vessel.

The conduit may terminate at the subsea support. Alternatively, the conduit may extend beyond the subsea support, for example to extend to another subsea, or otherwise, location.

The subsea support may be defined by a natural subsea structure. The subsea support may comprise the seabed. For example, the conduit may extend from the vessel to a touchdown point on the seabed, wherein said touchdown point defines the location of the subsea support. In use the conduit may deviate, for example due to sea conditions and vessel motion, such that the location of the touchdown point may vary. In such an arrangement the subsea support may be considered to be dynamic.

The conduit system may define a catenary riser system providing fluid communication between the vessel and subsea location.

The conduit may be secured to a seabed conduit at the location of the touchdown point. The seabed conduit may define an anchor for the conduit. For example, the weight of the seabed conduit may define a gravity anchor. Alternatively, or additionally, the seabed conduit may be secured to a rigid structure which functions as an anchor. The seabed conduit may be separately formed and subsequently secured to the conduit of the conduit system. In other embodiments the seabed conduit may be defined by the conduit. For example, the conduit may extend from the vessel to the touchdown point on the seabed, and then extend along the seabed from the touchdown point.

In embodiments where the subsea support is defined by or located in the vicinity of the seabed, the load arrangement may be connected to the conduit at a location within 50% of the water depth above the seabed. Thus, the load arrangement connection region may be located at a depth which is closer to the subsea support and seabed than the vessel. In some embodiments the region of connection of the load arrangement may be, for example, between 10 and 40% of the water depth above the seabed, in some embodiments between 10 and 30%, and in some embodiments between 10 and 20%. The precise location of the region of connection of the load arrangement may, however, be selected in accordance with, for example, precise operational conditions and requirements.

The subsea support may comprise or be defined by subsea infrastructure. Such infrastructure may comprise, for example, flow equipment such as manifold assemblies, hydrocarbon production facilities, production trees, flow structures, riser structures and the like. Such infrastructure may be associated with a subsea hydrocarbon production/exploration facility, subterranean injection facility or the like.

The subsea support may comprise subsea infrastructure which is positioned adjacent or on the seabed. In such an arrangement the conduit may also make contact with the seabed.

The subsea support may comprise subsea infrastructure which is located above the seabed. In this arrangement an intermediate region of the conduit may extend to a greater depth than both the vessel and the subsea support. For example, the conduit may define a hanging or sagging catenary form between the vessel and the subsea support. The intermediate or hanging region of the conduit may define the lowest suspended region of the conduit. In some embodiments the load arrangement may be secured to the conduit generally at the location of this lowest suspended intermediate or hanging region. This may permit the load arrangement to more uniformly apply tension along the conduit between the region of connection with the conduit and both the vessel and the subsea support.

The conduit may define a jumper between the vessel and the subsea support.

The conduit system may define a portion of a hybrid riser system. For example, the conduit of the conduit system may define a jumper which extends between a vessel and a vertical rigid riser portion of a hybrid riser system.

The load arrangement may be hung from the conduit. For example the load arrangement may be suspended from the conduit.

The load arrangement may comprise a weight assembly configured to apply a force on the conduit by the effect of gravity acting on the weight assembly.

The weight assembly may comprise a single weighted mass.

The weight assembly may comprise a plurality of individual masses. The individual masses may be coupled together. For example, the weight assembly may comprise a series of interlinked masses, for example in the form of a chain, wherein each mass defines an individual chain link. Such chain link weight has a number of advantages. For example, an appropriate number of links can be selected to provide a chain with a desired weight, and the length of the chain can be readily extended or shortened. Further, a chain is compliant if it impacts another object and is considered to be relatively easily handled using standard offshore practices and standards.

The individual masses may be isolated from each other and, for example, secured to a common connection region on the conduit. In one embodiment the load arrangement may comprise a support structure, such as an elongate element, which is coupled to the conduit, wherein multiple masses are secured to the support structure, for example along the length of the support structure.

The load arrangement may be configured to apply a static force on the conduit. That is, the force applied by the load arrangement may be generally constant, at least in magnitude. For example, the load arrangement may comprise or define a fixed weight which is entirely suspended from the conduit.

The load arrangement may be configured to apply a dynamic force on the conduit. That is, the force applied by the load arrangement may vary at least in magnitude over time. The load arrangement may be configured to apply a dynamic force on the conduit in accordance with deformation and/or deviation of the conduit, for example as might be caused by environmental conditions, motion of the vessel relative to the subsea support or the like. Accordingly, movement of the conduit during use may cause the force applied by the load arrangement to vary, which in turn will vary the tension generated within the conduit. Such a variation in tension may permit the stability and dynamic response of the conduit system to also vary. In this way, the conduit system may dynamically react to operational conditions to appropriately vary the dynamic response and stability of the conduit.

The load arrangement may comprise a variable weight assembly.

The load arrangement may comprise a weight assembly and be configured to selectively couple/decouple the effect of at least a portion of the weight assembly from the conduit. Such selective coupling/decoupling may be achieved in response to deformation/deviation of the conduit. At least a portion of the weight assembly may be configured to be selectively rested upon and lifted from a subsea support structure or formation during movement of the conduit. Accordingly, increasing weight being rested on the subsea support structure may result in a reduced force applied on the conduit, and vice versa. The subsea support structure may comprise or be defined by a natural structure, for example the seabed. In other embodiments the subsea support structure may comprise or be defined by an artificial structure.

The load arrangement may comprise a weight assembly having a plurality of interconnected chain links, wherein individual chain links may be rested upon and lifted from a subsea support structure, such as the seabed, during movement of the conduit.

The load arrangement may comprise an elastic assembly configured to selectively extend and contract in accordance with motion of the conduit, wherein such extension and contraction generates a variable lateral force applied on the conduit. The elastic assembly may comprise an elastic body, such as a nylon body or the like. The elastic assembly may comprise an elastic mechanical structure, such as a spring structure or the like.

The load arrangement may be configured to establish or generate tension within the conduit at all times.

The load arrangement may be secured or tethered to a subsea anchor. In such an arrangement the load arrangement may also function to tether the conduit to the subsea anchor. The subsea anchor may define a seabed anchor. The anchor may be provided by any suitable anchor as might be selected by a person of skill in the art, such as a gravity base, suction pile, drilled and grouted pile, driven pile, jetted pile and the like.

The load arrangement may extend in a general catenary form between the conduit and the subsea anchor. In such an arrangement the load arrangement may extend in a direction substantially opposite to the direction in which the conduit extends between the vessel and the subsea support.

An intermediate portion of the conduit may be tethered to a subsea anchor. The load arrangement may define a tether. The tether may limit the maximum movement or deviation of the conduit.

The conduit system may comprise a connection arrangement configured to permit attachment or connection of the load arrangement to the conduit.

The connection arrangement may permit the load arrangement to be secured to the conduit at a single connection point.

The connection arrangement may permit the load arrangement to be secured to the conduit at at least two connection points along the length of the conduit. In such an arrangement the connection arrangement may comprise a bridle system, yoke system or the like. Such an arrangement may actively promote and control curvature in the conduit while assisting to ensure curvatures in those sections adjacent the connection points are maintained within allowable levels. Furthermore, providing at least two connection points which are axially separated from each other along the length of the conduit may maintain a lower or actively reduce the tension within the conduit between the two connection points. Such a lower tension may promote increased bending and levels of curvature within this section between the connection points. This may assist to facilitate any change in direction or orientation in the conduit between that section extending between the vessel and the region of connection, and that section between the region of connection and the subsea support.

The connection arrangement may define at least two connection points on the conduit, wherein said connection points may be axially spaced along the conduit in the region of, for example 1 to 50 m, in some embodiments between 5 and 40 m, in some embodiments between 10 and 30 m, and in some embodiments between 10 and 20 m.

At least a portion of the connection arrangement may be defined by or on the conduit. For example, the conduit may comprise or define an integral profile or the like configured to be engaged by separate components of the connection arrangement and/or of the load arrangement.

The connection arrangement may comprise at least one conduit connector configured to engage the conduit and permit attachment of the load arrangement. The conduit connector may define a clamp which circumscribes and clamps around the conduit. In such an arrangement the connector may directly engage the conduit. In some embodiments an intermediate component may be positioned between the connector and the conduit, for example to provide improved frictional engagement, provide protection to the conduit and/or connector, to locally modify the strength, for example stiffness, of the conduit, or the like. The connector and/or conduit may define roughened and or serrated surfaces on a contact face to improve the interference between the connector and conduit.

The conduit connector may comprise a longitudinally split sleeve configured to be positioned around the conduit and the split sections of the sleeve secured together to effect clamping against the conduit. The conduit connector may comprise a fastening component mounted on the split sleeve permitting connection of the load arrangement thereto. The fastening component may comprise or define a shackle, eyelet, ringlet, hoop or the like. The fastening component may be rigidly secured to the sleeve. The fastening component may be non-rigidly mounted on the sleeve and configured to provide a degree of articulation between the fastening component and the sleeve. The conduit connector in such an arrangement may comprise a bearing surface arranged to accommodate engagement with the fastening component, for example between the fastening component and the sleeve. In one embodiment the fastening component may define a ring structure, such as a split ring structure, rotatably mounted on the sleeve. This rotatable ring arrangement may allow the load arrangement to generally hang vertically from the conduit. This may be important during installation when the load arrangement may need to be overboarded separately from the conduit and additionally, residual torsion in the conduit may make it difficult to know the final clamp orientation.

The connection arrangement may comprise a frame arrangement, such as a space frame arrangement or structure which is mounted on the conduit. The frame arrangement may define an articulated frame arrangement. This may permit a degree of control of the distribution of loads into the conduit. In some embodiments the frame arrangement may include buoyancy and/or ballast to tune the conduit and structural responses.

The conduit system may comprise ballast coupled to the conduit. The ballast may be coupled to the conduit at or near the region of connection of the load arrangement to the conduit.

Another aspect of the present invention may relate to a method for improving stability within a conduit which extends between a surface or near surface vessel and a subsea support, comprising:

securing a load arrangement to the conduit at a region of connection which is intermediate the vessel and the subsea support to apply a force on the conduit; and configuring the conduit such that the applied force generates axial tension in the conduit between the region of connection and the vessel.

A further aspect of the present invention may relate to a subsea conduit system comprising:

a conduit extending between a surface or near surface vessel and a subsea support, wherein the conduit comprises a composite material formed of at least a matrix and one or more reinforcing elements embedded within the matrix; and a load arrangement connected to the conduit at a region of connection which is intermediate the vessel and the subsea support, wherein the load arrangement is configured to apply a dynamic force on the conduit to dynamically modify the response of the conduit to operational conditions.

Another aspect of the present invention there may relate to a subsea conduit system comprising:

a conduit extending between a surface or near surface vessel and a subsea support, wherein the conduit comprises a composite material formed of at least a matrix and one or more reinforcing elements embedded within the matrix; and a weight arrangement connected to the conduit at a region of connection which is intermediate the vessel and the subsea support to apply a force on the conduit.

Another aspect of the present invention may relate to a riser system, comprising:

a riser conduit comprising a composite material and extending between a seabed location and a vessel; and a dynamic tether secured between a seabed anchor and an intermediate portion of the riser conduit, wherein the dynamic tether is configured to dynamically alter tension applied to a portion of the riser conduit.

A further aspect of the present invention may relate to a riser system comprising:

a subsea riser section secured between a lower subsea anchor and an upper buoyant structure;

a flexible conduit extending between the lower riser section and a surface or near surface vessel; and a load arrangement connected to the flexible conduit at a region of connection which is intermediate the vessel and the subsea riser section to apply a force on the flexible conduit.

Another aspect of the present invention may relate to a conduit system, comprising:

a conduit extending between first and second supports, wherein at least a portion of the conduit is submerged within a body of water; and a load arrangement connected to the conduit at a region of connection which is intermediate the first and second supports to apply a force on the conduit.

The load arrangement may be configured to modify the dynamic response and the structural stability of the conduit, for example in response to interaction with the body of water, relative motion of the first and second supports and the like.

The load arrangement may be connected to the conduit at a submerged region of the conduit.

One or both of the first and second supports may be located outwith the body of water. One or both of the first and second conduits may be located submerged or at least partially submerged within the body of water.

One of the first and second supports may comprise a surface or near surface vessel.

One of the first and second supports may comprise a subsea structure or formation, such as a natural seabed structure, artificial subsea structure or the like.

Features defined and implied in relation to the subsea conduit system according to the first aspect may be applied to or in combination with the conduit system according to the seventh aspect.

Another aspect of the present invention may relate to a connecting arrangement for permitting connection to a conduit, comprising:

a longitudinally split sleeve configured to be positioned around a conduit and split sections of the sleeve secured together to effect clamping against the conduit; and a ring rotatably mounted on the sleeve and comprising a fastening arrangement to permit connection thereto.

The fastening arrangement may comprise an eyelet, bore, shackle or the like.

Any feature, optional or otherwise, defined in relation to one aspect may be utilised in combination with any other aspect.

BRIEF DESCRIPTION OF DRAWINGS

These and other aspects of the present invention will now be described, by way of example only, with reference to the accompanying drawings, in which.

DETAILED DESCRIPTION OF THE DRAWINGS

Figure 1:
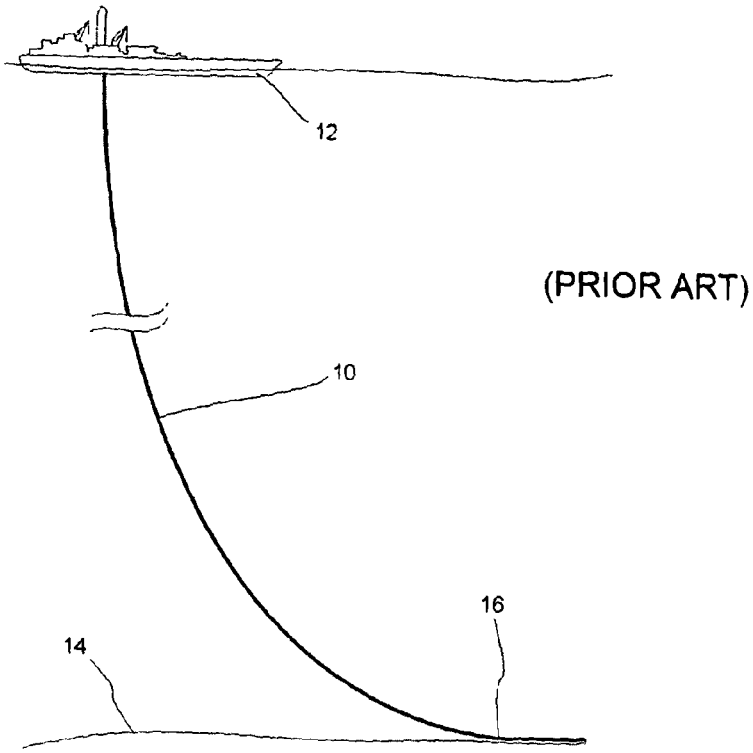
FIG. 1 is a diagrammatic representation of a known steel catenary riser configuration.
Figure 2:
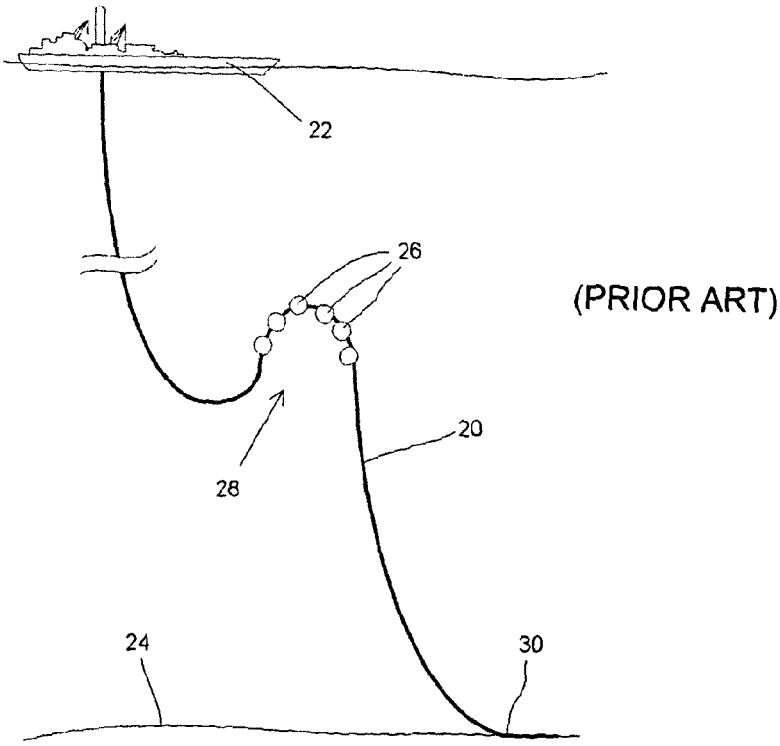
FIG. 2 is a diagrammatic representation of a known wave form steel riser configuration.
Figure 3:
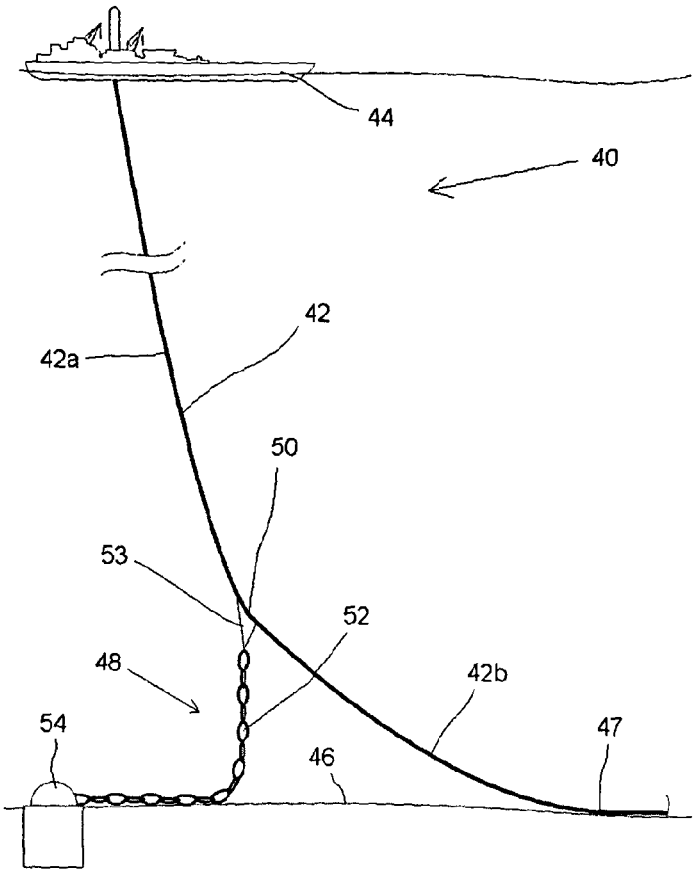
FIG. 3 is a diagrammatic illustration of a subsea conduit system, specifically a riser system, in accordance with an embodiment of the present invention.

A subsea conduit or riser system, generally identified by reference numeral 40, in accordance with an embodiment of the present invention is diagrammatically illustrated in FIG. 3. The system 40 includes a conduit or riser 42 which extends in a general catenary form between a surface vessel 44 and the seabed 46, and defines a touchdown point 47 with the seabed 46. The riser conduit 42 facilitates transfer of fluids between a subsea location, for example from a subsea hydrocarbon production facility (not shown), and the vessel 44, which may define a FPSO vessel. The riser conduit 42 may be formed of any suitable material. However, in the illustrated embodiment the conduit 42 is formed from a composite material of a matrix and reinforcing elements embedded within the matrix. Although different variations of composite material are possible, in the present embodiment the matrix comprises polyether ether ketone (PEEK) with carbon fibre reinforcing elements embedded within the PEEK matrix.

The composite construction of the conduit 42 permits said conduit to exhibit sufficiently high strength to accommodate pressure and other applied loadings. Furthermore, the composite construction permits the conduit 42 to exhibit improved behaviour to strain, for example to exhibit increased strain rates to specific stress. This may permit the conduit 42 to accommodate greater levels of axial and bending strains, for example. Also, the composite construction of the fluid conduit 42 may permit significantly improved thermal characteristics in comparison to non-composite structures. For example, the composite construction may provide greatly reduced thermal conductivity which reduces heat loses and allows the need for insulation to be eliminated or greatly reduced. Furthermore, the composite construction may assist to minimise thermal expansion characteristics. For example, the composite construction of the conduit 42 may permit lower axial length variation compared to non-composite structures and thus assist to eliminate or at least alleviate associated problems. However, even in circumstances where axial length variation does occur, such variations can be accommodated by the composite construction by virtue of an increased ability to accommodate higher strain rates. Thus, for example, axial compression and tensile forces may be more readily accommodated. Furthermore, any lateral deformations caused by axial extension may also be readily accommodated without risk of exceeding operational yield limits.

The composite construction may also permit the conduit 42 to define a lower weight per unit length than non-composite structures, such as metallic and non-bonded pipe. While this can provide significant advantages over non-composite structures, for example in terms of handling, vessel loading and the like, in some circumstances this lighter weight may result in the conduit 42 exhibiting dynamic response and stability issues, particularly where the conduit 42 is utilised in deep water. For example, the conduit 42 could provide relatively small resistance to deformations/deviations which may be caused by sea conditions and vessel motion. The present invention seeks to address such an issue. However, it should be understood that the present invention may readily also be utilised where the conduit 42 is formed from a heavier material.

The system 40 further comprises a load arrangement 48 connected to the conduit 42 at a region of connection 50 which is intermediate the vessel 44 and the touchdown point 47. In the present embodiment the load arrangement 48 comprises a length of chain 52 secured to the conduit 42 via a bridle system 53 such that the weight of the chain 52 applies a lateral force on the conduit 42 at the region of connection 50. As illustrated, this lateral force modifies the natural catenary form such that the conduit 42 adopts a dog-leg type catenary, having an upper section or leg 42*a* which extends between the vessel and the region of contact 50, and a lower section or leg 42*b* which extends between the region of contact 50 and the touchdown point 47. The profile or orientation of the conduit 42 is such that the lateral force applied by the weight of the chain 52 generates tension along the complete length of the conduit 42, specifically in the upper section 42*a* between the region of connection 50 and the vessel 44, and in the lower section 42*b* between the region of connection 50 and the touchdown point 47.

The presence of the lateral force and the generated tension permits the dynamic response of the conduit 42 to be improved relative to an unloaded conduit. For example, the lateral force and the tension generated may permit the conduit 42 to exhibit a greater static inertia and thus stability to resist deformation or deviation caused by external forces, such as water current loading and vessel motion. Further, the load arrangement and generated tension may permit the conduit 42 to resist lower external forces, while being capable of a degree of compliancy to the effects of increasing external forces. Also, the applied lateral force and generated tension can permit the conduit 42 to exhibit a dynamic response and level of stability which is more typical of heavier conduits. This may permit lighter weight conduits to be utilised where they might otherwise be disregarded as inappropriate.

The chain 52 of the load arrangement 42 is secured to a seabed anchor 54 such that the chain 52 may define a tether between the anchor 54 and conduit 42. The chain 52 extends between the region of connection 50 and the anchor 54 generally in the form of a catenary, and in particular in the form of a catenary which is opposite to that of the conduit 42.

The load arrangement 48 in the present embodiment is configured to apply a dynamic force on the conduit 42. That is, as the conduit 42 is moved according to external effects, such as water currents and vessel motions, the chain 52 will be progressively lifted from and rested on the seabed 46, thus varying the weight being applied on the conduit at the region of connection 50, and in turn varying the tension being generated along the conduit 42. Such a variation in tension may permit the stability and dynamic response of the conduit 42 to also vary. In this way, the conduit 42 may dynamically react to operational conditions to appropriately vary the dynamic response and stability of the conduit 42.

Figure 4:
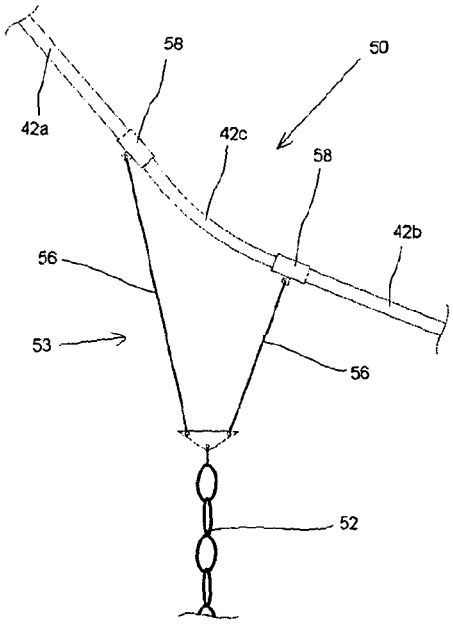
FIG. 4 is an enlarged view of the riser system of FIG. 3 in the region of connection of a load arrangement.

An enlarged view of the system 40 of FIG. 3 in the region of connection 50 is illustrated in FIG. 4. The bridle system 53 in the embodiment shown secures the chain 52 to the conduit 42 via two strops 56 and respective clamp connectors 58 which engage the conduit 42 at two axially spaced connection points. In the exemplary embodiment the connectors 58 may be separated by between 10 and 20 m. Accordingly, an intermediate conduit section 42*c* is defined between the connectors 58. The axial separation of the connectors 58 assists to maintain a lower tension within the intermediate conduit section 42*c*, particularly relative to the upper and lower conduit sections 42*a*, 42*b*. Such a lower tension may promote increased bending and levels of curvature within this section 42*c*. For example, the strains within the intermediate section 42*cd* may be predominantly bending strains, with axial strains being minimised. Accordingly, the global strain in this section 42*c* may be minimised. This may assist to facilitate any change in direction or orientation between the upper and lower conduit sections 42*a*, 42*b*.

Figure 5:
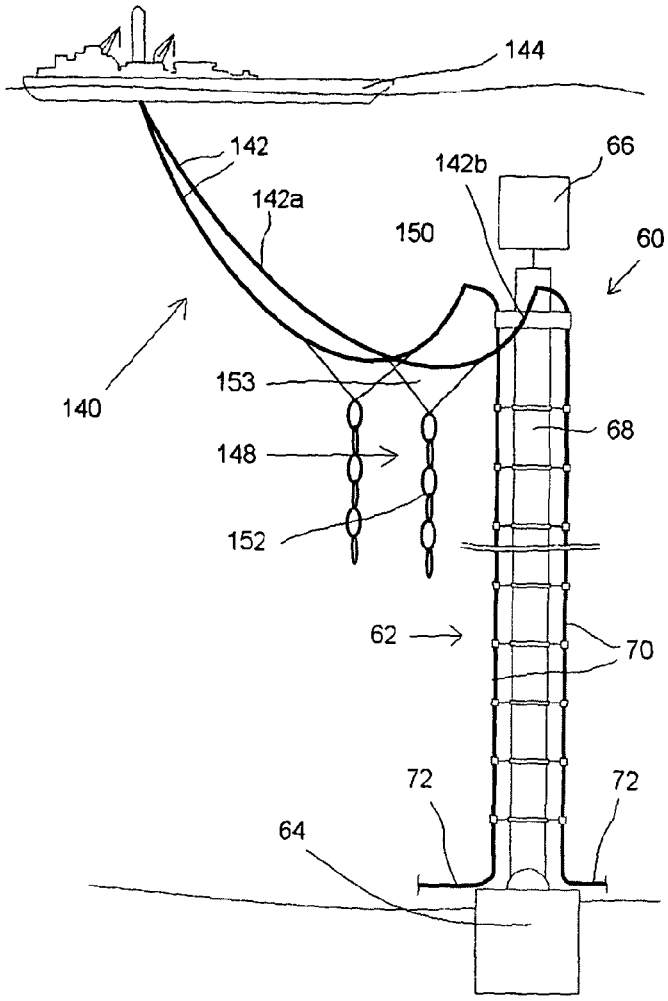
FIG. 5 is a diagrammatic illustration of a subsea conduit system, specifically a flexible jumper conduit system, in accordance with an alternative embodiment of the present invention.

An alternative embodiment of a conduit system, generally identified by reference numeral 140 is illustrated in FIG. 5, reference to which is now made. Conduit system 140 is similar to system 40 of FIG. 3 and as such like components share like reference numerals, incremented by 100. In the present embodiment the conduit system 140 forms part of a hybrid riser system 60 for transferring fluids from a seabed location to a surface vessel 144, such as a FPSO vessel. The riser system 60 includes a lower riser section 62 which extends between a seabed anchor 64 and a buoyant structure in the form of an aircan 66. The aircan 66, which is positioned below the water surface and thus isolated from surface conditions, provides an upward thrust to apply tension to the riser section 62 and to hold said section in a substantially vertical upright position.

The lower riser section 62 comprises a central elongate support 68 in the form of a pipe string which is evacuated and sealed. The lower end of this elongate support 68 is secured to the anchor 64, and the upper end is coupled to the aircan 26. Accordingly, the upward thrust from the aircan 66 is applied along the support 68.

A plurality of peripheral fluid conduits 70 extend adjacent the elongate support 68. The lower ends of the conduits 70 are secured to respective feed conduits 72 which carry fluids, such as hydrocarbons, to be communicated via the riser system 20 to the surface vessel 21.

The conduit system 140 defines a jumper arrangement which extends between the lower riser section 62 and the surface vessel 21. In the illustrated embodiment the system 140 includes a plurality of flexible conduits 142 in fluid communication with respective composite fluid conduits 32 of the lower riser section 22. Accordingly, fluid from the feed lines 72 may be communicated to the surface vessel 144 via the fluid conduits 70 and conduits 142. For clarity and brevity of the present description only a single conduit and associated structure and components will be described.

Conduit 142 is flexible and generally free-hanging to extend in a catenary configuration between the vessel 144 and the lower riser section 62. A load arrangement 148 is secured to the conduit 142 at a region of connection 150 which is intermediate the vessel 144 and the lower riser section 62. Specifically, the region of connection 150 is generally located at the lowermost hanging region of the conduit 142. In the present embodiment the load arrangement 148 comprises a length of chain 152 secured to the conduit 142 via a bridle system 153 such that the weight of the chain 152 applies a lateral force on the conduit 142 at the region of connection 150. In the present embodiment the load arrangement applies a generally static force on the conduit 142. The profile or orientation of the conduit 142 is such that the lateral force applied by the weight of the chain 152 generates tension along the complete length of the conduit 142, specifically in conduit section 142*a* between the region of connection 150 and the vessel 144, and in conduit section 142*b* between the region of connection 150 and the riser section 162.

In a similar manner to that described in relation to the embodiment of FIG. 3, the presence of the lateral force and the generated tension permits the dynamic response and stability of the conduit 142 to be improved relative to an unloaded conduit.

Figure 6:
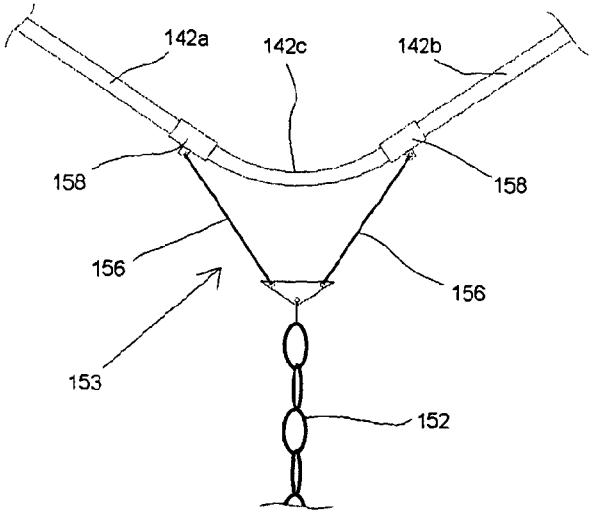
FIG. 6 is an enlarged view of a portion of the flexible jumper system of FIG. 5 in the region of connection of a load arrangement.

An enlarged view of the system 140 of FIG. 5 in the region of connection 150 is illustrated in FIG. 6, and it will be recognised that this is similar to the arrangement shown in FIG. 3. Accordingly, the bridle system 153 secures the chain 152 to the conduit 142 via two strops 156 and respective clamp connectors 158 which engage the conduit 142 at two axially spaced connection points such that an intermediate conduit section 142*c* is defined between the connectors 158. In a similar manner to that described above the axial separation of the connectors 158 assists to maintain a lower tension within the intermediate conduit section 142*c*, particularly relative conduit sections 142*a*, 142*b*.

Figure 7:
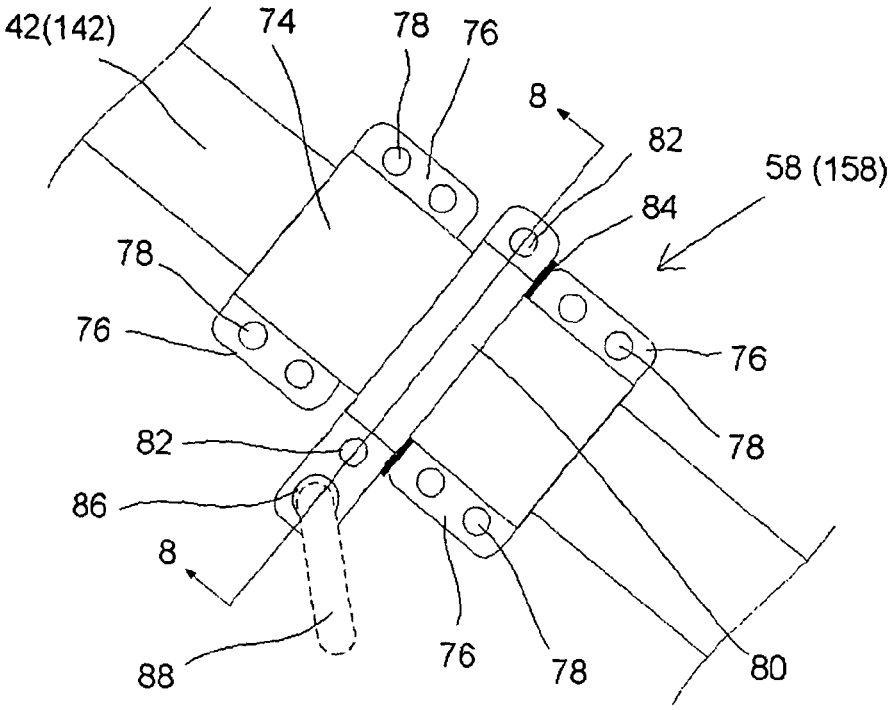
FIG. 7 is an enlarged view of a connection clamp in accordance with an embodiment of the present invention.
Figure 8:
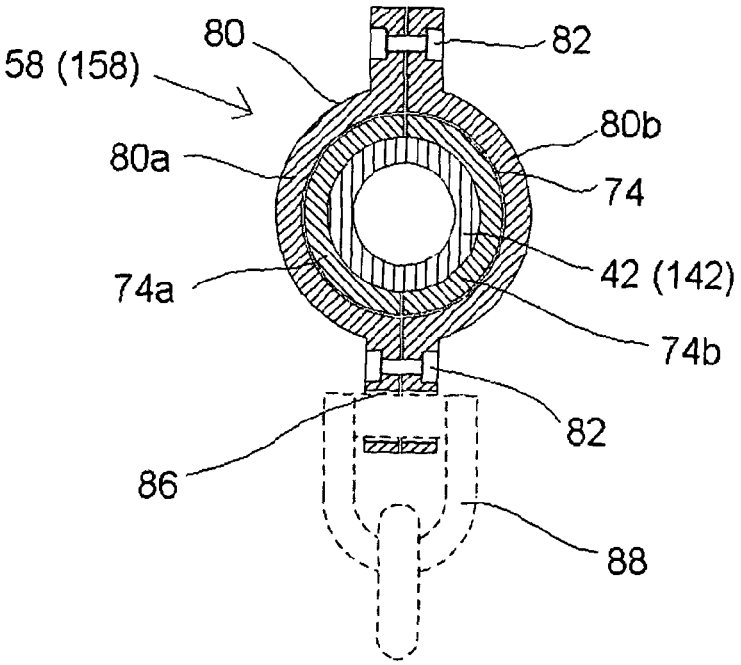
FIG. 8 is a lateral cross-section of the connection clamp taken through line 8-8 of FIG. 7.

An exemplary embodiment of a clamp connector 58 (158) will now be described with reference to FIGS. 7 and 8, wherein FIG. 7 is a side elevation view of a connector 58 (158) secured to a conduit 42 (142), and FIG. 8 is a lateral cross section through line 8-8 of FIG. 7.

The connector 58 (158) comprises a sleeve 74 formed in two longitudinally split halves 72*a*, 72*b* (FIG. 8) which are mounted on the conduit 42 (142) and secured together via flanges 76 and bolts 78 such that the sleeve may be clamped against the conduit 42 (142). In some embodiments the conduit 42 (142) may comprise a structural variation at this region of clamped connection, for example to provide a localised region of increased strength. A connection ring 80 formed in two halves 80*a*, 80*b* (FIG. 8) is rotatably mounted on the sleeve 74 intermediate the flanges 76 so as to be captured therebetween. The halves 80*a*, 80*b* of the ring 80, once mounted on the sleeve 74, are secured together by bolts 82, and once the halves 80*a*, 80*b* are secured together the ring 80 is free to rotate on the sleeve 74. A bearing ring 84 is located on the sleeve 84 to provide a bearing surface between the ring 80 and flanges 76. The ring 80 defines a radial extension which includes an eyelet 86 to which a strop (not shown) may be secured, for example via a shackle 88, shown in broken outline.

The ability of the ring 80 to rotate about the sleeve 74 allows the attached load arrangement to generally hang vertically from the conduit 42 (142). This may be important during installation when the load arrangement may need to be overboarded separately from the conduit 42 (142) and additionally, residual torsion in the conduit 42 (142) may make it difficult to know the final clamp orientation.

It should be understood that the embodiments described are merely exemplary and that various modifications may be made thereto without departing from the scope of the invention. For example, in the embodiment shown in FIG. 3 the load arrangement comprises a chain which is dynamically lifted from and rested on the seabed to vary the force applied to the conduit. However, in other embodiments this effect may be achieved by use of an elastic body, structure or mechanism which is secured between the conduit and an anchor. Furthermore, principles of the present invention may be applied to other conduits systems, for example other subsea jumper arrangements and the like.

The invention claimed is:

1. A subsea single catenary riser system comprising:

a conduit comprising a composite material formed of at least a matrix and one or more reinforcing elements embedded within the matrix, the conduit extending between a surface vessel and a subsea structure, wherein the surface vessel and subsea structure are subject to relative motion therebetween; and a load arrangement connected between a subsea anchor and the conduit at a region of connection which is intermediate the vessel and the subsea structure to tether the conduit to the subsea anchor and to generate axial tension in the conduit between the region of connection and the vessel, and between the region of connection and the subsea structure;

wherein the conduit extends between the vessel and subsea structure in single catenary form to define the single catenary riser system.

2. The system according to claim 1, wherein the force applied by the load arrangement is aligned axially relative to the conduit.

3. The system according to claim 1, wherein the force applied by the load arrangement is aligned laterally relative to the conduit.

4. The system according to claim 1, wherein the load arrangement modifies the dynamic response of the conduit to dynamic service loading relative to an unloaded conduit.

5. The system according to claim 1, wherein the conduit extends continuously upwards between the region of connection with the load arrangement and the vessel.

6. The system according to claim 1, wherein the conduit extends continuously downwards between the region of connection with the load arrangement and the subsea structure.

7. The system according to claim 1, wherein the load arrangement causes the conduit to define a dog-leg catenary form, having a first leg portion extending between the vessel and the region of connection of the load arrangement, and a second leg portion between the region of connection and the subsea structure.

8. The system according to claim 1, wherein the load arrangement comprises a weight assembly to apply a force on the conduit by the effect of gravity acting on the weight assembly.

9. The system according to claim 8, wherein the weight assembly comprises a plurality of individual masses.

10. The system according to claim 1, wherein the load arrangement comprises a chain.

11. The system according to claim 1, wherein the load arrangement applies a dynamic force on the conduit to dynamically alter the generated axial tension in the conduit in accordance with movement of the conduit.

12. The system according to claim 1, wherein the load arrangement comprises a variable weight assembly to apply a dynamic force on the conduit.

13. The system according to claim 1, wherein the load arrangement comprises a weight assembly and is configured to selectively couple/decouple the effect of at least a portion of the weight assembly from the conduit.

14. The system according to claim 13, wherein at least a portion of the weight assembly is selectively rested upon and lifted from the subsea structure or formation during movement of the conduit.

15. The system according to claim 1, wherein the load arrangement comprises an elastic assembly to selectively extend and contract in accordance with motion of the conduit, wherein such extension and contraction generates a variable force applied on the conduit.

16. The system according to claim 1, wherein the load arrangement is configured to establish or generate tension within the conduit at all times.

17. The system according to claim 1, wherein the load arrangement extends in a single catenary form between the conduit and the subsea anchor.

18. The system according to claim 17, wherein the load arrangement extends in a direction substantially opposite to the direction in which the conduit extends between the vessel and the subsea structure.

19. The system according to claim 1, wherein the conduit extends from the vessel to a touchdown point on the seabed, wherein said touchdown point defines the location of the subsea structure.

20. The system according to claim 19, wherein, in use, the location of the touchdown point varies due to motion of the conduit.

21. The system according to claim 19, wherein the conduit is secured to a seabed conduit at the location of the touchdown point.

22. The system according to claim 21 wherein the seabed conduit defines an anchor for the conduit.

23. The system according to claim 22, wherein the weight of the seabed conduit defines a gravity anchor.

24. The system according to claim 19, wherein the load arrangement is connected to the conduit at a location within 50% of the water depth above the seabed.

25. The system according to claim 1, wherein the entire axial length of the conduit extending between the vessel and the subsea structure comprises a composite material.

26. The system according to claim 1, wherein discrete portions of the axial length of the conduit comprise a composite material.

27. The system according to claim 1, wherein the entire wall thickness of at least one axial section of the conduit is formed of the composite material.

28. The system according to claim 27, wherein the quantity of reinforcing elements varies through the wall thickness of the conduit, from zero at the inner region of the wall of the conduit, and increases in quantity in an outwardly radial direction.

29. The system according to claim 1, wherein the region of the conduit to which the load arrangement is connected defines a local variation in construction to provide a local region of increased strength.

30. The system according to claim 1, comprising a connection arrangement to permit connection of the load arrangement to the conduit.

31. The system according to claim 30, wherein the connection arrangement permits the load arrangement to be secured to the conduit at least two connection points along the length of the conduit.

32. The system according to claim 30, wherein the connection arrangement comprises a bridle system.

33. The system according to claim 30, wherein the connection arrangement comprises a longitudinally split sleeve to be positioned around the conduit and the split sections of the sleeve secured together to effect clamping against the conduit.

34. The system according to claim 33, wherein the connection arrangement comprises a fastening component mounted on the split sleeve permitting connection of the load arrangement thereto.

35. The system according to claim 34, wherein the fastening component comprises a ring structure rotatably mounted on the sleeve.

36. The system according to claim 30, wherein the connection arrangement comprises a space frame arrangement mounted on the conduit.

37. The system according to claim 1, wherein the conduit defines a single component extending between the vessel and subsea structure.

38. A method for establishing communication between a surface vessel and a subsea structure, wherein the surface vessel and subsea structure are subject to relative motion therebetween, comprising:

extending a riser conduit comprising a composite material formed of at least a matrix and one or more reinforcing elements embedded within the matrix between the vessel and the subsea structure;

connecting a load arrangement between a subsea anchor and the conduit at a region of connection which is intermediate the vessel and the subsea structure to tether the conduit to the subsea anchor and to generate axial tension in the conduit between the region of connection and the vessel, and between the region of connection and the subsea structure;

wherein the conduit extends between the vessel and subsea structure in a single catenary form to define a single catenary riser system.

39. A subsea single catenary riser system comprising:

a conduit comprising a composite material formed of at least a matrix and one or more reinforcing elements embedded within the matrix, the conduit extending between a surface vessel and a subsea structure which are subject to relative motion therebetween, wherein the conduit comprises a composite material formed of at least a matrix and one or more reinforcing elements embedded within the matrix; and a load arrangement connected between a subsea anchor and the conduit at a region of connection which is intermediate the vessel and the subsea structure, wherein the load arrangement is configured to apply a dynamic force on the conduit to dynamically modify the response of the conduit to operational conditions;

wherein the conduit extends between the vessel and subsea structure in a single catenary form to define the single catenary riser system.

40. A riser system, comprising:

a riser conduit comprising a composite material formed of at least a matrix and one or more reinforcing elements embedded within the matrix and extending between a seabed location and a vessel; and a dynamic tether secured between a seabed anchor and an intermediate portion of the riser conduit, wherein the dynamic tether dynamically alters tension applied to a portion of the riser conduit;

wherein the conduit extends between the vessel and subsea structure in a single catenary form to define a single catenary riser system.

* * * * *